US005485869A

United States Patent [19]

Haynes

[11] Patent Number: 5,485,869

[45] Date of Patent: Jan. 23, 1996

[54] HYDRAULIC DUAL SOLENOID DIRECTIONAL CONTROL VALVE WITH MANUAL OVERRIDE LOCK-OUT LINKAGE

[75] Inventor: Ronald L. Haynes, Searcy, Ark.

[73] Assignee: Vickers, Incorporated, Maumee, Ohio

[21] Appl. No.: 175,955

[22] Filed: Dec. 30, 1993

[51] Int. Cl.[6] ..... F15B 13/01; F15B 13/044

[52] U.S. Cl. ..... 137/625.65; 251/90; 251/129.03; 251/129.1

[58] Field of Search ..... 137/625.65; 251/129.03, 251/129.1, 90, 100

[56] References Cited

U.S. PATENT DOCUMENTS 20,788 7/1858 Getty ..... 251/100 X

OTHER PUBLICATIONS

Latching manual override on solenoid DG4V–3 DG4V–3S (Undated).

Drawing (Undated) Representing the Prior Art Described on p. 1, Lines 12–19 of the Specification.

*Primary Examiner*—Gerald A. Michalsky

*Attorney, Agent, or Firm*—Barnes, Kisselle, Raisch, Choate, Whittemore & Hulbert

[57] ABSTRACT

In accordance with the invention, the hydraulic dual solenoid directional control valve embodying the invention includes means at each end of the hydraulic dual solenoid directional control valve which includes a hinge fixed to the coil at each end, a lever pivoted to the hinge and an elbow connected to the hinge and connected to a common rod. The rod has a non-circular sleeve, preferably square, which projects normally through a complementary opening in a projection on one of the hinges. When the rod is moved in one direction, the sleeve and rod are moved such that an interference fit is provided with rotation between the sleeve and the projection on one hinge causing the lever to yieldingly apply force to the pin of the corresponding solenoid, actuating the valve in one direction. When the rod is actuated in the opposite direction and then rotated after clearing the sleeve from the opening in the hinge, the sleeve provides an interference fit with the other side of the other hinge such that the lever on the other end of the valve is actuated and held in position having shifted the spool of the valve in the opposite direction.

5 Claims, 5 Drawing Sheets

60a
58a
46a
42a
44a
48a
40a
38a
50
22
20
52
38
36
40
60
46
48
42
44
66
64

HYDRAULIC DUAL SOLENOID DIRECTIONAL CONTROL VALVE WITH MANUAL OVERRIDE LOCK-OUT LINKAGE

This invention relates to hydraulic dual solenoid directional control valves and particularly to a lockable manual override for such valves.

BACKGROUND OF THE INVENTION

In hydraulic dual solenoid directional control valves, it is old and well known to provide a push pin on each end of the solenoid so that in the event of power failure, the pin can be manually pushed and held inwardly to actuate the valve.

It has been also previously suggested that a linkage be provided at each end which is in the form of a latch at each end for selectively moving the push pin from each end.

A further suggestion has been to provide an arrangement wherein levers at each end of the valve are interconnected by a shaft so that pushing or pulling the shaft will selectively actuate the push pins at one end or another and rotating the shaft will lock the shaft axially by a key and slot arrangement between the coil and the shaft. Such an arrangement has been found rather costly, complex and not reliable.

Accordingly, among the objectives of the present invention are to provide a hydraulic dual solenoid directional control valve with a manual override lock-out linkage which is relatively simple; utilizes a minimum number of parts; has a reliable and repeatable mechanical construction and which provides a linkage whereby both solenoids can be controlled from one end of the valve.

SUMMARY OF THE INVENTION

In accordance with the invention, the hydraulic dual solenoid directional control valve embodying the invention includes means at each end of the hydraulic dual solenoid directional control valve which includes a hinge fixed to the coil at each end, a lever pivoted to the hinge and an elbow connected to the hinge and connected to a common rod. The rod has a non-circular sleeve, preferably square, which projects normally through a complementary opening in a projection on one of the hinges. When the rod is moved in one direction, the sleeve and rod are moved such that an interference fit is provided with rotation between the sleeve and the projection on one hinge causing the lever to yieldingly apply force to the pin of the corresponding solenoid, actuating the valve in one direction. When the rod is actuated in the opposite direction and then rotated after clearing the sleeve from the opening in the hinge, the sleeve provides an interference fit with the other side of the other hinge such that the lever on the other end of the valve is actuated and held in position having shifted the spool of the valve in the opposite direction.

DESCRIPTION

Figures 1, 5, 6:
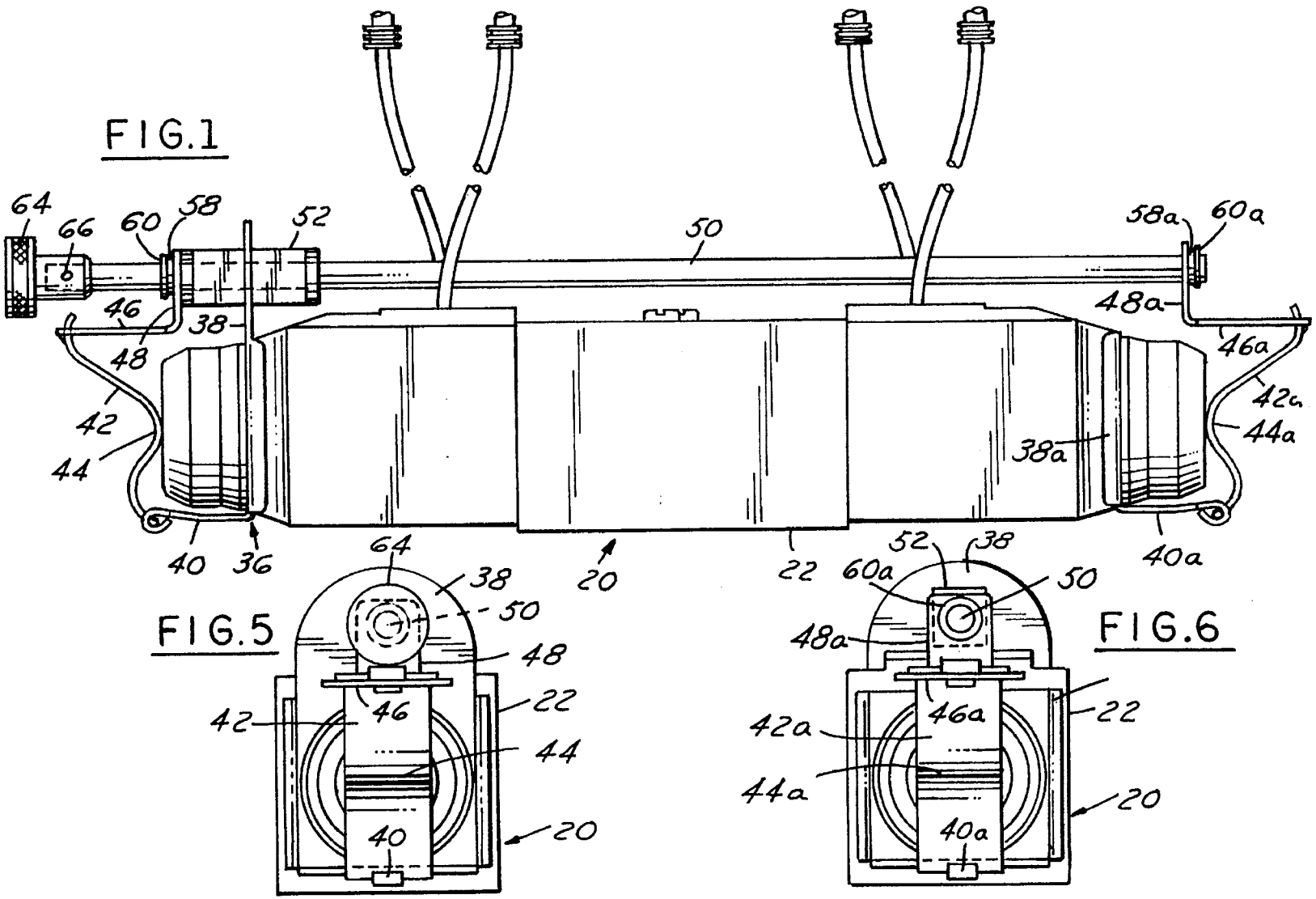
FIG. 1 is a side elevational view of a hydraulic dual solenoid directional control valve with a manual override lock-out linkage embodying the invention.
FIG. 5 is a view taken from the left as viewed in FIGS. 1and 2.
FIG. 6 is a view taken from the right as viewed in FIGS. 1 and 2.
Figure 2:
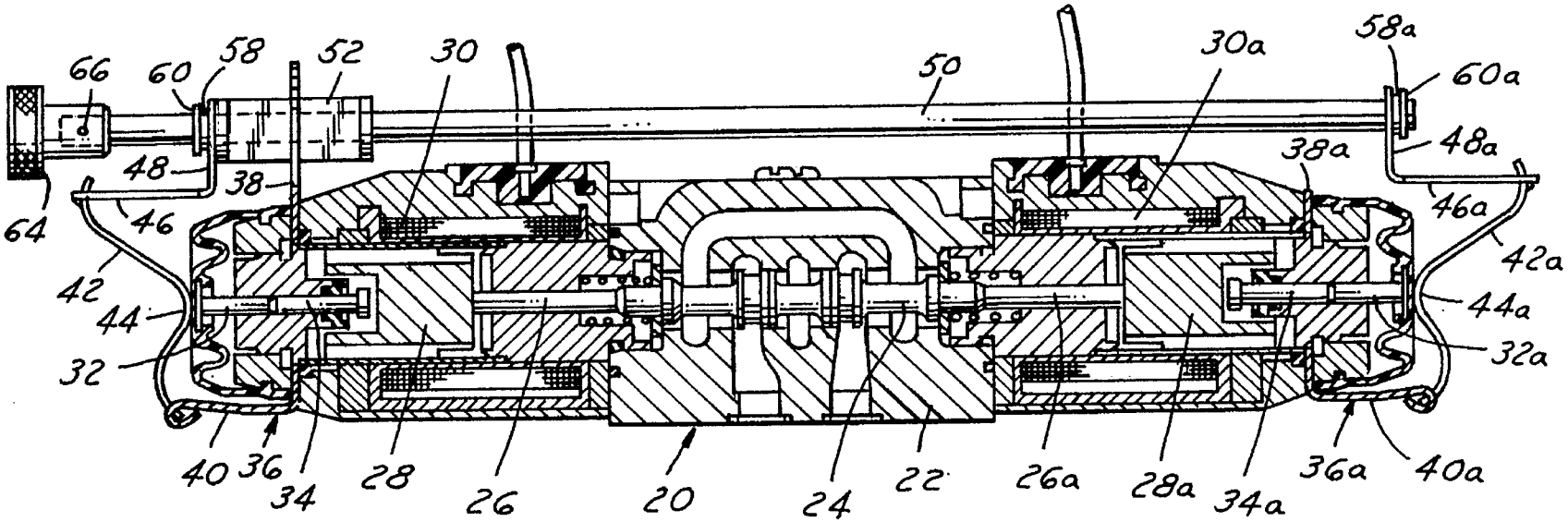
FIG. 2 is a longitudinal sectional view therethrough.
Figure 3:
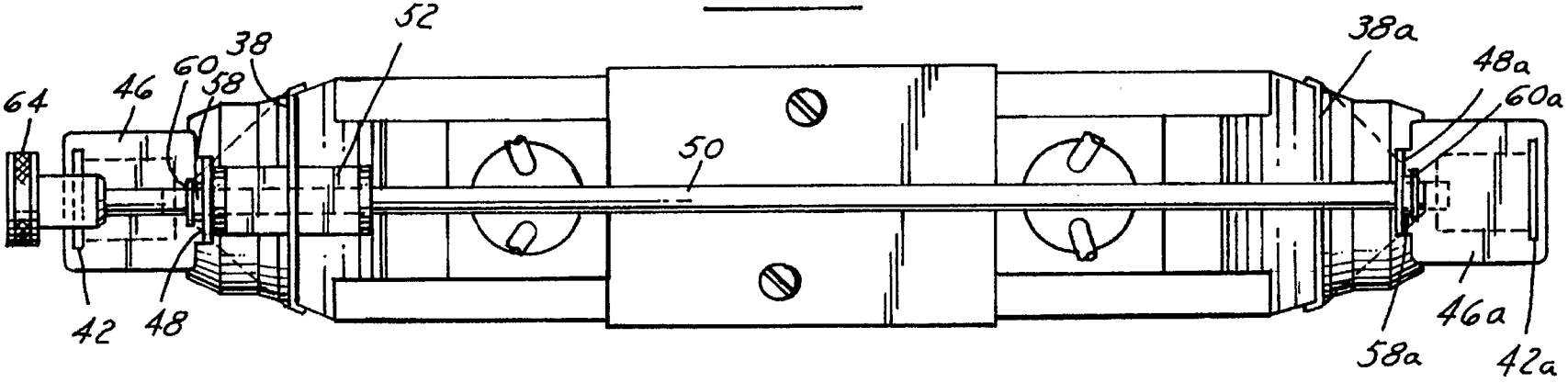
FIG. 3 is a top plan view.
Figure 4:
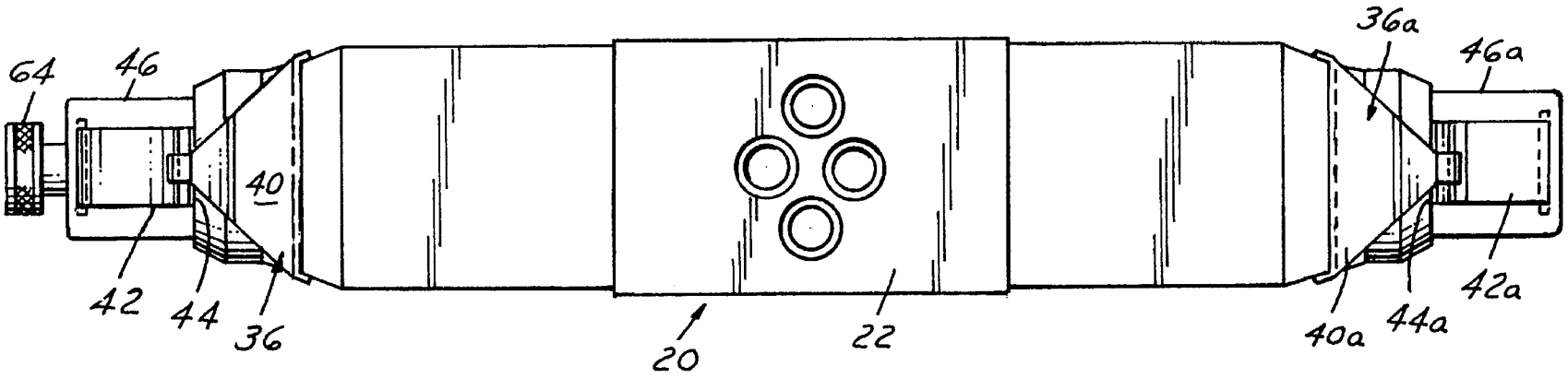
FIG. 4 is a bottom plan view.

Referring to FIGS. 1 and 2, the invention relates to a hydraulic dual solenoid directional control valve 20 of an old and well known type which includes a body 22. A four way directional valve spool 24 controls inlet and outlet ports. The valve spool 24 is controlled at each end by a push pin 26 **26*a*, acted upon by an armature 28, 28*a* that acts as a magnet when a solenoid coil 30, 30*a* is energized at each end. When power is applied to the solenoid, either DC or AC as is well known in the art, the magnetic field pushes or pulls the associated armature 28, 28*a* to shift the valve spool 24. A push pin 32, 32*a* is normally provided at each end and engages an intermediate pin 34, 34*a*** for manually overriding the valve and manually operating the valve in the event of a power failure of the like. Such a dual solenoid directional valve is well known.

In accordance with the invention, the hydraulic dual solenoid directional control valve embodying the invention includes an L-shaped hinge member 36 at one end that has a transverse portion 38 mounted on the coil 30 and a longitudinal portion 40 to which a lever 42 is mechanically hinged. Lever 42 has an intermediate portion 44 extending inwardly toward push pin 32. An elbow member 46 is mechanically hinged to lever 42 and includes a transverse end 48. A similar L-shaped hinge member **36*a*, is provided at the other end of the valve and has a corresponding lever 42*a* and elbow member 44*a*** associated therewith.

Figures 7, 8, 9, 10, 11, 14:
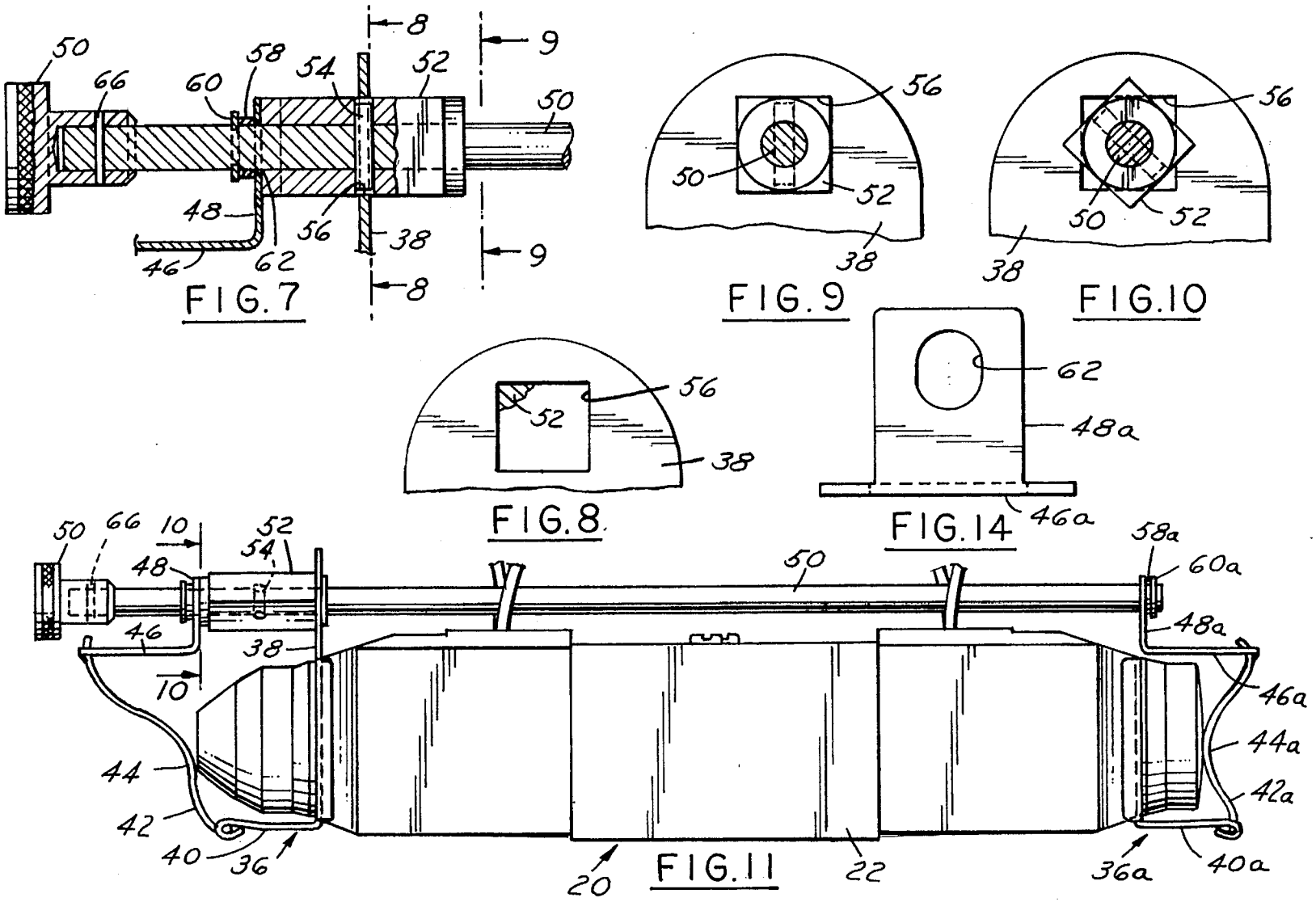
FIG. 7 is a fragmentary sectional view on an enlarged scale of a portion at the left in FIG. 2.
FIG. 8 is a view taken along the lines 8—8 in FIG. 7, parts being broken away.
FIG. 9 is a view taken along the lines 9—9 in FIG. 7.
FIG. 10 is a view similar to FIG. 9 taken along the lines 10—10 in FIG. 11.
FIG. 11 is a view similar to FIG. 1 showing the parts in a different operative position.
FIG. 14 is an end view of a portion of an elbow member shown on the right FIG. 1.
Figure 12:
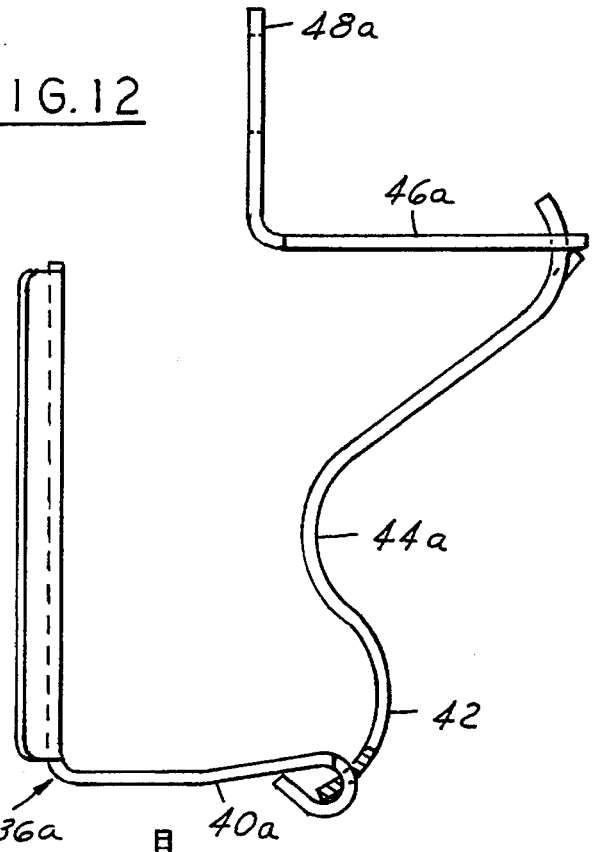
FIG. 12 is a view taken on an enlarged scale of a portion of the linkage shown on the right in FIGS. 1 and 2.
Figure 13:
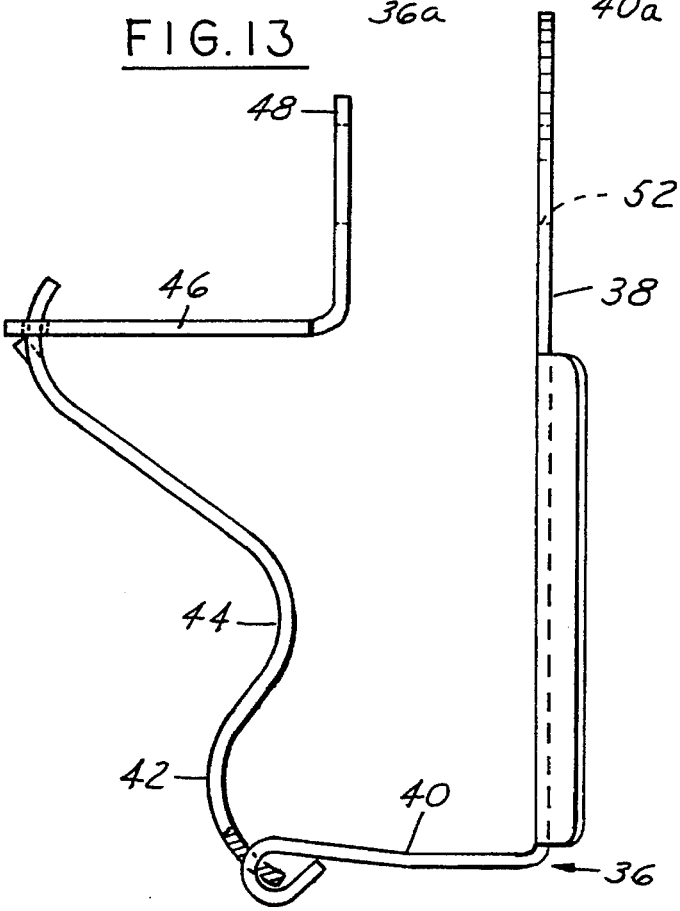
FIG. 13 is a fragmentary view of a portion of the linkage on the left in FIGS. 1 and 2.

A rod 50 is provided for simultaneously pushing or pulling movement. A sleeve 52 is connected to the rod 50 by a pin 54 (FIG. 7) intermediate the ends of rod 50 adjacent portion 38 of hinge member 36. The sleeve 52 is non-circular preferably square and in the neutral position extends through a square opening 56 in hinge portion 38 (FIG. 9). The elbow portion 48 is held in engagement with sleeve 52 by a spacer 58 and snap ring 60. The rod 50 also extends through an enlarged elongated opening 62 (FIG. 15) in the elbow portion **48*a* and a snap ring 60 holds a spacer 58*a* against the elbow portion 48*a*. A knob 64 is fixed to the one end of rod 50 by a pin 66**.

The hinge members 36, **36*a*, levers 42, 42*a* and elbow members 46, 46*a*** are preferably made of metal such as steel which has some ability to flex in the lever portion.

When the rod 50 is pulled longitudinally along its axis in one direction (to the left in FIGS. 1, 2), the sleeve 52 and rod 50 are moved to cause the sleeve to clear the opening 56 and the rod 50 is rotated that an interference is provided on the reduced end of the sleeve 52 between a square portion of the sleeve 42 and the hinge portion 38*a* causing the lever 42*a* to yieldingly apply force to pins 32*a*, 34*a* to move and the valve spool 24 of the solenoid in one position.

When the rod 50 is actuated in the opposite direction and then rotated after clearing the sleeve 52 from the opening 56 in the hinge projection 38, the sleeve 52 provides an interference fit with the other side of the sleeve 52 such that lever 42 at the other end of the valve is actuated and held in position having shifted the spool 24 through pins 32, 34 of the valve in the opposite direction (FIG. 11).

Provision of a square sleeve 52 and square opening 62 provides for a number of interference positions such that the spool will be held readily by a limited rotation of rod 50.

It can thus be seen that this has been provided a hydraulic dual solenoid directional control valve with a manual override lock-out linkage which is relatively simple; utilizes a minimum number of parts; has a reliable and repeatable mechanical construction and which provides a linkage whereby both solenoids can be controlled from one end of the valve.

I claim:

1. A hydraulic solenoid directional control valve comprising a valve body, a valve spool controlling inlet and outlet ports, a coil at each end, an armature associated with each coil, push pin means associated with each armature, a hinge member fixed to the coil at each end, a lever mechanically hinged to each hinge member, an elbow member mechanically hinged to said lever, a common rod, each said elbow member having an opening, said openings being aligned, said rod extending through said openings, a sleeve on one end of said rod, said sleeve having a polygonal cross section, mechanical means non-rotatably connecting said sleeve to said rod and holding said sleeve against movement relative to said rod, said hinge member at said one end of said rod having a polygonal opening complementary to the cross section of said sleeve through which said sleeve normally extends such that when the rod is moved in one direction and rotated, the sleeve and rod are moved such that an interference fit is provided at a plurality of positions as the sleeve and rod are rotated relative to the opening such that rotation between the sleeve and the projection on one hinge member causes the lever to yieldingly apply force to the push pin means of the corresponding solenoid actuating the valve in one direction, and when the rod is actuated in the opposite direction and then rotated after clearing the sleeve from the opening in the hinge member, the sleeve provides an interference fit with the other side of the hinge member at one end such that the lever on the other end of the valve is actuated to apply a force to the other push pin means and hold the push pin means in position having shifted the spool of the valve in the opposite direction.

2. The hydraulic dual solenoid directional control valve set forth in claim 1 wherein said sleeve is square in cross section and said opening in said one hinge member is square in cross section such that moving the rod and rotating the rod provides a plurality of interference positions between the sleeve and the hinge depending on the degree of rotation.

3. The hydraulic dual solenoid control valve set forth in claim 1 wherein said sleeve is fixed on said rod by a transverse pin.

4. The hydraulic dual solenoid control valve set forth in claim 3 including a knob fixed to one end of said rod by a transverse pin.

5. The hydraulic dual solenoid directional valve set forth in claim 4 wherein the hinge member at said one end by engagement of the sleeve with a spacer and a snap ring and a spacer and snap ring at the other end of the rod hold the hinge member in contact with said hinge member at the other end.

* * * * *